United States Patent [19]

Ferguson

[11] 4,370,236

[45] Jan. 25, 1983

[54] PURIFICATION OF HYDROCARBON STREAMS

[75] Inventor: Robert C. Ferguson, Bartlesville, Okla.

[73] Assignee: Phillips Petroleum Company, Bartlesville, Okla.

[21] Appl. No.: 217,068

[22] Filed: Dec. 16, 1980

[51] Int. Cl.[3] ..... B01D 11/04

[52] U.S. Cl. ..... 210/634; 202/176; 203/10; 204/136; 204/302; 210/748; 210/799; 210/805; 210/806; 210/243

[58] Field of Search ..... 55/37, 55, 124; 423/150; 210/634, 767, 806, 805, 765, 919, 748, 777, 778, 799; 204/299, 164, 168, 152, 193, 302, 136; 48/196 R; 202/176; 203/10, 11, 73, 80, DIG. 16

[56] References Cited

U.S. PATENT DOCUMENTS

| | | | |
|---|---|---|---|
| 887,666 | 5/1908 | Lester | 204/152 X |
| 1,853,393 | 4/1932 | Anderson | 55/124 X |
| 2,768,062 | 10/1956 | Kartenbeck | 55/124 X |
| 2,776,725 | 1/1957 | Wood | 55/124 |
| 3,089,750 | 5/1963 | Samuelson et al. | 204/302 |
| 3,686,090 | 8/1972 | Plennry | 204/302 |
| 3,821,110 | 6/1974 | Luetzetschnab | 210/765 |
| 3,886,757 | 6/1975 | McClintock et al. | 62/20 |
| 4,002,565 | 1/1977 | Larrell et al. | 210/765 |
| 4,014,667 | 3/1977 | Barber | 203/18 X |
| 4,179,347 | 12/1979 | Krause et al. | 204/152 X |
| 4,252,631 | 2/1981 | Horarongtung | 204/302 |
| 4,290,882 | 9/1981 | Dempsey | 210/748 X |

OTHER PUBLICATIONS

Pipe Line Industry, Nov. 1961, pp. 40–42, "Electrostatic Precipitator Removes Corrosion Products from NGL Lines," L. E. Lee.

"Horizontal Metercell Precipitator for Distillate-Type Fuels," cutaway perspective view from Howe-Baker, Inc.

*Primary Examiner*—Robert H. Spitzer

[57] ABSTRACT

A hydrocarbon stream containing particulate and water-soluble compound is purified by admixture therewith of an aqueous solution followed by electrostatic precipitation of the aqueous and particulate phases from the hydrocarbon phase. The aqueous phase is separated from the particulate phase and recycled. Preferably, the aqueous phase is fractionated recovering methanol overhead and recycling a portion of the kettle product containing primarily water and not more than 20 volume percent ethylene glycol.

15 Claims, 1 Drawing Figure

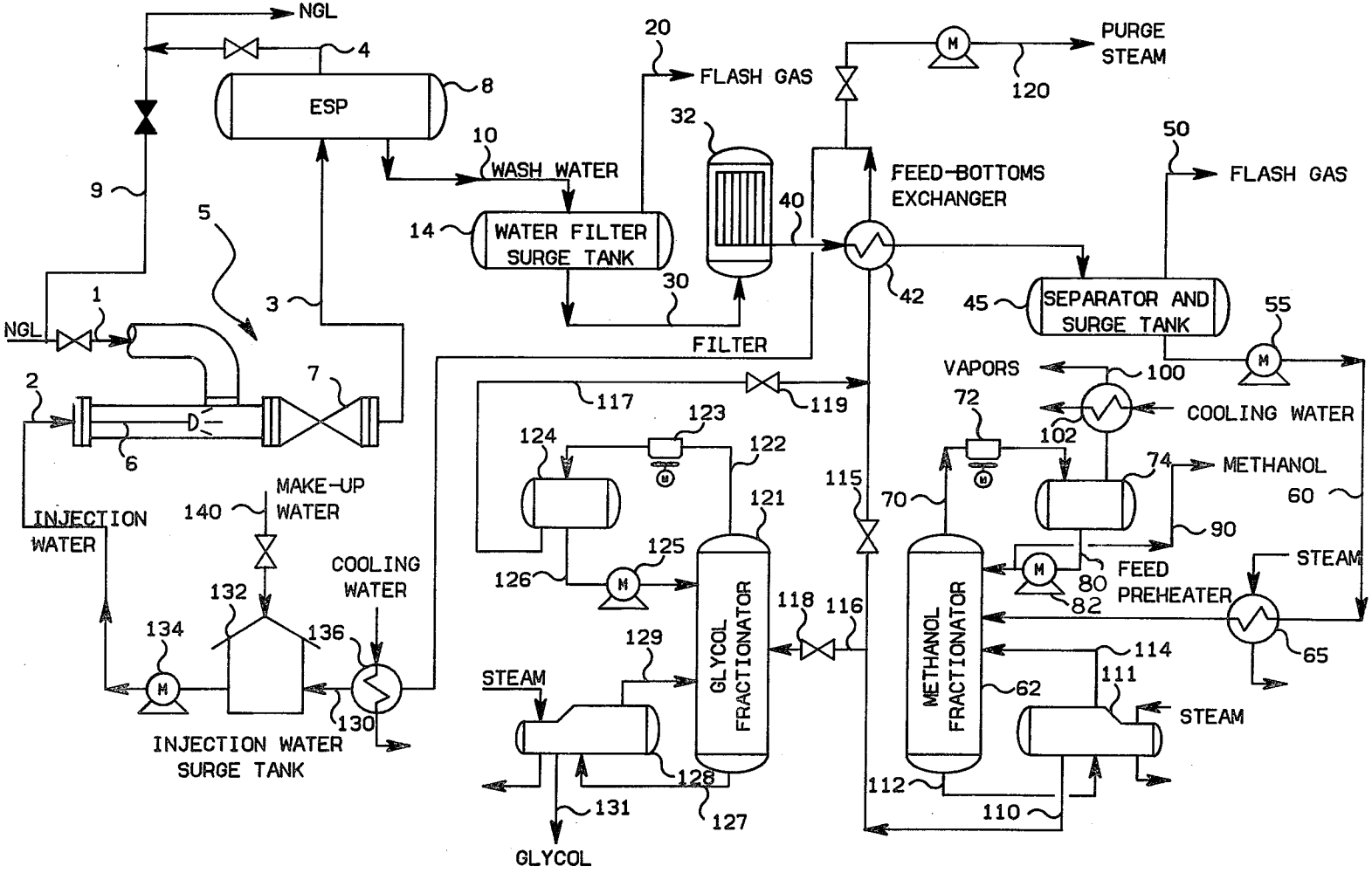
FLASH GAS
PURGE STEAM
SEPARATOR AND SURGE TANK
COOLING WATER
METHANOL
STEAM
FEED PREHEATER
FEED-BOTTOMS EXCHANGER
VAPORS
METHANOL FRACTIONATOR
FILTER
GLYCOL FRACTIONATOR
WASH WATER
WATER FILTER SURGE TANK
ESP
NGL
MAKE-UP WATER
INJECTION WATER
INJECTION WATER SURGE TANK
GLYCOL

PURIFICATION OF HYDROCARBON STREAMS

BACKGROUND OF THE INVENTION

The invention relates to hydrocarbon processing. In another aspect, the invention relates to the purification of natural gas liquids. In yet another aspect, the invention relates to an improved process employing an electrostatic precipitator for purifying a natural gas liquid stream.

In the processing of hydrocarbons, especially natural gas liquids, hereinafter "NGL", comtaminants often cause serious operating problems. Cryogenic gasoline plants frequently utilize materials such as methanol and glycol in their processes. Significant concentrations of methanol and glycol thus frequently exist in NGL pipelines.

Additionally, methanol is frequently injected as a dewpoint depressant into NGL pipelines, especially during the cold parts of the year. The purpose of the methanol is to prevent hydrate formation between certain components of the NGL and water, which is frequently also present as a contaminant in NGL pipelines. Furthermore, amines are frequently injected as corrosion inhibitors into NGL pipelines.

Naturally occuring contaminants in NGL pipelines include carbon dioxide and hydrogen sulfide. These materials are highly corrosive to pipelines constructed from materials containing iron, especially when water is present in the NGL as a cocontaminant. The hydrogen sulfide frequently attacks the interior surfaces of such pipelines forming particulate iron sulfide. The iron sulfide particles, a portion of which are in the micron size range are extremely difficult to remove from the NGL. Additionally, iron sulfide is pyrophoric, and when dry can present an ignition hazard around refineries and plants when exposed to oxygen-containing gas, such as air.

Iron sulfide additionally causes serious operating problems by fouling heat exchange equipment. The fouling results in reduced capacity and increased down time for cleaning.

Methanol and ethylene glycol when present in NGL feed are difficult to dispose of in an environmentally sound manner. In view of the fact that these materials frequently traverse NGL pipelines as slugs, waste water treaters must have very high design capacities for satisfactory operation. Furthermore, ethylene glycol and methanol interfere with the separation of $CO_2$ and $H_2S$ from NGL streams by amine treaters. For example, when the NGL is contacted with diethanol amine (DEA) solution, the glycol accumulates in the circulating DEA system. The subsequent dilution effect decreases DEA concentration, and both NGL treating and DEA regeneration are affected adversely. In addition, the increase in DEA solution inventory creates a serious disposal problem.

Heavy organic materials, such as gums and sludges, are also sometimes present as contaminants in NGL streams. These materials create problems by fouling filters and heat exchange equipment which results in decreased capacity and increased down time for cleaning.

OBJECTS OF THE INVENTION

It is an object of this invention to provide an economical method for removing contaminants from streams of hydrocarbons, especially natural gas liquids.

It is a further object of this invention to recover the contaminants from hydrocarbons, especially from natural gas liquids, as valuable products.

It is another object of this invention to remove and recover contaminants from hydrocarbons such as natural gas liquids by utilizing an aqueous wash liquid, which is recycled to mitigate disposal problems.

It is yet another object of this invention to provide an apparatus for accomplishing the above objects.

SUMMARY OF THE INVENTION

According to one embodiment of the invention, a liquid hydrocarbon stream comprising hydrocarbons as its major component and containing a particulate material and at least one additional contaminant selected from the group consisting of water, hydrogen sulfide, carbon dioxide, methanol, ethylene glycol and amine as its minor component is contacted with an aqueous wash liquid to form a mixture having a hydrocarbon phase and an aqueous phase. The contaminants enter the aqueous phase from the hydrocarbon phase and the particulate material is wetted and settles by gravity from the hydrocarbon phase. A purified liquid hydrocarbon stream can be withdrawn from the hydrocarbon phase and a wash stream containing the particulate can be withdrawn from the aqueous phase. The wash stream is filtered to remove at least a portion of the particulate material, and at least a portion of it is recycled to the aqueous wash liquid stream. Preferably, the wash stream is subjected to flashing to remove hydrogen sulfide and carbon dioxide and to fractionation to remove methanol prior to recycle. Ethylene glycol can be removed by fractionation or in a purge stream, as desired.

According to another embodiment of the invention, an apparatus comprising an electrostatic precipitator, a filter, a first conduit emptying into the electrostatic precipitator, a first means for defining a flow path from a lower portion of the electrostatic precipitator to the filter, and a second means for defining a flow path between the filter and the first conduit is provided which is well adapted for carrying out the process of the present invention.

THE DRAWING

The drawing illustrates in schematic certain preferred features of the present invention.

DETAILED DESCRIPTION OF THE INVENTION

A liquid hydrocarbon stream carried by a conduit 1 is contacted with an aqueouhydrocarbon stream 1 comprises hydrocarbon as its major component, and particulate material and at least one contaminant selected from the group consisting of water, hydrogen sulfide, carbon dioxide, methanol, ethylene glycol, and amine as its minor component. The aqueous wash liquid stream 2 comprises water as its major component. Generally, the aqueous wash liquid stream 2 also contains ethylene glycol, at concentrations of up to about 20 percent by volume. Usually, the water flow through the line 2 is between about 1 and 5 percent by volume of the hydrocarbon flow through line 1. However, this percentage applies only to the water content of the liquid in the line 2. If the aqueous wash liquid contains recycled ethylene glycol, the rate of aqueous wash liquid flow must be increased to compensate. Preferably, the water flow through the line 2 is about 3 percent by volume of the flow through line 1.

Preferably, the hydrocarbon in the line 1 comprises $C_1$–$C_6$ hydrocarbons as its major component. Such hydrocarbons form the natural gas liquid fraction of hydrocarbon streams. Generally, the NGL line 1 will be at a pressure between about 100 and 600 pounds per square inch absolute (psia), depending upon its content of light ends such as methane and ethane, usually at about 400 psi, and will be at about ambient temperature, usually between about 40° F. and about 100° F. It is desirable that the hydrocarbon contain little or essentially no water-soluble salts of Group IA or IIA metals, as excessive amounts of these materials can build-up in the aqueous wash liquid and cause operational problems in certain embodiments of the present invention.

Preferably, the aqueous wash liquid is introduced into the NGL stream via a spray nozzle 6 which is designed to produce an initial, bulk premixing of the phases to form a mixture. A suitable nozzle is a full jet 30° nozzle manufactured by Spraying Systems Company, of Wheaton, Ill. The mixture is then passed through a valve 7 to achieve a more efficient mixing and to create an extremely fine dispersion of aqueous wash liquid in the liquid hydrocarbon stream.

The pressure drop across the valve 7 is an indication of the degree of mixing. The optimum pressure drop for satisfactory mixing will be determined by operating experience. It is important not to use more pressure drop than required. An excessive pressure drop will cause an undesirable back pressure increase in the NGL line 1 which will decrease pipeline capacity and increase pumping costs. Excessive pressure drop can also create an NGL-water emulsion that is hard to break. A preferred valve 7 is a throttling ball valve or Vee-ball® type. A Vee-ball type valva manufactured by Fisher Controls Company of Marshalltown, Iowa has been employed with good results. Preferably, the pressure drop across the valve 7 is maintained between about 3 and 10 psi. From the valve 7, the mixture then passes via a line 3 to a separating vessel 8, preferably an electrostatic precipitator. A bypass line 9 from the NGL line 1, normally closed, is provided around the mixing device 5 and the electrostatic precipitator 8 for cleaning of the mixing device 5 and/or the electrostatic precipitator 8 when necessary.

Electrostatic precipitators are well known in the field of liquid-liquid phase separation. The electrostatic precipitator works on the principle that when an electrically conductive liquid is dispersed into a nonconductive liquid, a separation into two phases can be accomplished rapidly and completely by passing the mixture through a high voltage, direct current electrostatic field. In the present invention, the conductive liquid is the aqueous wash liquid which is widely dispersed as small droplets in the liquid hydrocarbon phase present in the vessel 8. The droplet size and dispersion of the aqueous wash liquid are functions of the mixing energy imposed in the valve 7. Upon entering the electrostatic field, the small dispersed droplets acquire an electrical charge which produces a random motion of the particles dependent on the particle size and the strength of the electrostatic field. The imparted motion greatly increases particle collision and results in the coalescence of small droplets into larger drops with sufficient mass to settle rapidly by gravity into the lower portion of the vessel 8. An electrostatic precipitator which has been employed with good results in the present invention is available from Howe-Baker Engineers, Inc., of Tyler, Tex.

A purified liquid hydrocarbon stream is withdrawn from the upper portion of the vessel 8 via a conduit 4 communicating therewith and e lower portion of the vessel 8 via a conduit 10 communicating therewith. The wash stream leaving the vessel 8 contains the contaminants extracted from the NGL stream. It is desirable to remove at least a portion of the contaminants so that at least a portion of the wash water can be recycled for reuse as aqueous wash liquid carried by conduit 2.

The wash stream is conveyed by a suitable means for defining a flow path to a filter 32. Preferably, a surge tank 14 is disposed in flow communication between the conduit 10 and a conduit 30. The conduit 30 is in flow communication with the filter 32. An overhead line 20 also communicates with surge tank 14. When employed, the surge tank 14 serves as both filter feed surge and also surge for abnormally large quantities of incoming contaminants in the NGL line 1. The surge volume of the tank 14 is sufficiently large to prevent design capacities of the downstream equipment from being exceeded. In addition to providing surge, the surge tank 14 operates at a lower pressure than the precipitator 8, such as from between about 50 and 100 psig, for example 75 psig, and the reduction in pressure on the wash stream in the surge tank 14 allows most of the dissolved hydrocarbons, hydrogen sulfide and carbon dioxide to flash apart from the wash liquid and be conveyed away for further processing via the conduit 20.

At least a portion of the particulate is filtered from the wash stream in the filter 32 to form a filtered wash stream which is conveyed from the filter 32 by a conduit 40 communicating therewith. The filter 32 is preferably of the precoat vertical leaf type. Preferably, a body feed suspension of diatomaceous earth type filtering material such as filter aid and water is injected into the wash water carried by the line 30 upstream of the filter 32 to promote formation of a porous and effective filter cake on the filter leaves. Preferably, a pair of filters 32 are employed with only one at a time on stream while the other is on standby. The operating filter remains on stream until a predetermined pressure drop, for example, 50 psi, is achieved across the filter. At this time, the operating filter is placed on standby, and the standby filter is actuated. The filter previously on stream is dumped, and its leaves are sluiced with fresh water. The vessel contents and the sluice water preferably empty by gravity into a sludge bin (not shown) from which they can be removed periodically by suitable means, for example a vacuum truck, for transportation to an evaporation pond. Since the sludge from the filter 32 contains iron sulfide which is pyrophoric in the dry state, it is important that care be taken during transfer operations to ensure that no portion of the filter sludge is allowed to dry. Graham Buffalo Model VS-150-3 vertical leaf pressure filters of the precoat type are presently preferred, as they have been employed with good results in filtering iron sulfide particles a major portion of which have a size in the range of from about 0.5–1000 microns. At least a portion of the filtered wash stream withdrawn from the filter 32 by the conduit 40 is recycled back to the aqueous wash liquid stream carried by the conduit 2, preferably by a means defining a flow path as hereinafter described.

When the feed stream carried by the conduit 1 contains methanol, the wash stream is conveyed by a suitable means for defining a flow path from the filter to a means for separating methanol from the wash stream. Preferably, the filtered wash stream carried by the conduit 40 is routed via a conduit 60 to a separation zone 62, such as a methanol fractionator. Preferably, a surge tank 45 is disposed in flow communication between the conduits 40 and 60. It is further preferred that a feed-bottoms heat exchanger be disposed in the conduit 40 between the filter 32 and surge tank 45. From the filter 32, the filtered wash water carried by the conduit 40 is heated in the heat exchanger 42 to an elevated temperature, for example, between 100° F. and 200° F., preferably about 150° F., by indirect heat exchange with bottoms product from the fractionator 62. The indirect heat exchange serves two purposes. First is energy conservation. Second is that the additional heat supplied to the filtered wash water stream carried by the conduit 40 in the heat exchanger 42 aids in ridding the stream of any remaining dissolved gases during a preferable subsequent downstream flash in the surge tank 45. The surge tank 45 acts as a feed surge for the fractionator 62. Additionally, the pressure of the filtered wash water introduced into the tank 45 from the line 40 is preferably reduced to atmospheric pressure in the tank, so that most of the remaining dissolved gases flash off and can be withdrawn from the tank 45 via a conduit 50 communicating with an upper portion of the tank 45 for further processing or disposal. The surge tank 45 is further preferably equipped with the system of baffles and weirs so that any liquid hydrocarbons which may be present can be separated from the filtered wash water in surge tank 45 and drained as required by a conduit not shown. The surge tank 45 is preferably employed in the practice of the invention as excessive amounts of dissolved gases in the filtered wash stream and/or slugs of hydrocarbon liquids in the filtered wash stream when fed to the fractionator 62 can cause serious upsets of the column.

A pump 55 associated with the conduit 60 is operable to withdraw filtered wash liquid from a lower portion of the surge tank 45 and cause the same to flow to the fractionator 62. Preferably, a heat exchanger 65 is associated with the conduit 60 between the surge tank 45 and the fractionator 62. The filtered wash liquid is preferably heated to an elevated temperature in the heat exchanger 65, for example, a temperature between about 225° and 300° F., preferably about 240° F. and is then introduced into the fractionator 62. Preheating of the filtered wash liquid by indirect heat exchange with 50 psig steam in the heat exchanger 65 has been utilized with good results.

The fractionator 62 separates the filtered wash water stream into an overhead product carried by conduit 70 which is enriched in methanol and a kettle product of wash water and heavy materials. When glycol is present in the NGL stream carried by the conduit 1, the heavy materials in the kettle product comprise mostly glycol and products formed from glycol.

The overhead vapors carried by the conduit 70 from the fractionator 62 are cooled and partially condensed in a heat exchanger, such as an air fin cooler 72 associated with the conduit 70 and pass into a reflux accumulator 74 into which the conduit 70 empties. Noncondensible gases from the accumulator 74 are withdrawn overhead by a conduit 100 communicating with an upper portion of the accumulator 74, and are preferably cooled in a heat exchanger, such as a vent condenser 102 before being routed for further processing, for example, to a sulfur unit. Methanol reflux to the fractionator 62 is supplied from the accumulator 74 by a pump 82 associated with a conduit 80 establishing communication between a lower portion of the accumulator 74 and an upper portion of the fractionator 62. When the overhead vapors carried by the conduit 70 from the fractionator contain methanol in excess of that required for reflux requirements, surplus methanol can be withdrawn as a stream from the accumulator via a conduit 90, preferably cooled to a temperature of below about 95° F., and routed to a storage tank not shown. The methanol product in line 90 will preferably have a minimum methanol content of 90 volume percent.

Heat is supplied to the fractionator 62 at least partially by a reboiler 111 in which a kettle bottoms stream carried by a conduit 112 from a lower portion of the fractionator 62 to the reboiler 111 is preferably heated by indirect heat exchange with steam. Fifty psig steam has been employed with good results. A portion of the kettle product, comprising mostly water and dissolved heavy materials, is drawn off the reboiler via a conduit 110. Reboiled kettle product is reintroduced into the fractionator 62 by a conduit 114 establishing communication between the reboiler 111 and a lower portion of the fractionator 62.

At least a portion of the kettle product carried by the conduit 110 is returned as recycle by a suitable means for defining a flow path to the aqueous wash liquid stream carried by the conduit 2. It is preferable that the concentration of ethylene glycol in the conduit 2 be maintained below about 20% by volume, as higher concentrations can harm system performance. In accordance with a further aspect of the invention, the concentration of ethylene glycol in the aqueous wash liquid carried by the conduit 2 is controlled by a suitable means for withdrawing ethylene glycol from the filtered wash liquid stream, such as by fractionation and/or by disposal of at least a portion of fluid carried by the conduit 110.

For removal of at least a portion of the ethylene glycol by fractionation a pair of conduits 116 and 117 communicate with the conduit 110. A valve 118 is disposed in the conduit 116, a valve 119 is disposed in the conduit 117, and a valve 115 is disposed in the conduit 110 between the conduits 116 and 117. The conduit 116 empties into a glycol fractionator 121. The flow rate of fluid into the glycol fractionator 121 is controlled by manipulating the valves 115, 118 and 119. Preferably, each of the valves 115, 118 and 119 is maintained in a partially opened position in the practice of this embodiment of the present invention, so that a portion of the fluid carried by the conduit 110 is conveyed to the glycol fractionator 121. This embodiment is preferred because it allows employment of a fractionator having a relatively low design capacity with good results.

Preferably, the fractionator 121 is operated so as to maintain concentration of ethylene glycol in the fluid carried by the conduit 2 of less than about 20% by volume. A conduit 122 communicates with an upper portion of the fractionator 121 and conveys overhead vapors through a heat exchanger, such as an air fin cooler 123, where they are at least partially condensed, and into a reflux accumulator 124. The fluid contained in the reflux accumulator 124 is enriched in water and lean of ethylene glycol. Surplus fluid not needed for reflux can be withdrawn from the accumulator by the conduit 117, which communicates with the accumulator, and reintroduced into the line 110, preferably upstream of the feed-bottoms exchanger 42. Water reflux for the fractionator 121 is supplied from the accumulator 124 by a pump 125 associated with a conduit 126 establishing communication between a lower portion of the accumulator 124 and an upper portion of the fractionator 121.

Bottoms product from the fractionator 121 is withdrawn via a conduit 127 communicating with a lower portion of the fractionator 121 and conveyed to a reboiler 128. The fluid in the reboiler 128 is heated by indirect heat exchange with a suitable heat exchange medium, such as 150 psig steam and at least a portion is reintroduced into the fractionator 121 by a conduit 129 establishing communication between an upper portion of the reboiler 128 and a lower portion of the fractionator 121. An enriched ethylene glycol stream can be withdrawn from the kettle product of the fractionator 121 via a conduit 131 communicating with a lower portion of the reboiler 128 and routed to storage or other use as desired.

Where the natural gas liquids contain only a small quantity of ethylene glycol, its separation by fractionation may be economically unjustified. In this case, valves 118 and 119 would be closed, and the glycol fractionator 121 would be bypassed by the conduit 110. The conduit 110 is operably associated with the feed-bottoms exchanger 42 for indirect heat exchange between the bottoms stream from the methanol fractionator 62 (and the overhead stream from the glycol fractionator 121 when employed), and the filtered wash water stream carried by the conduit 40. After passage through the feed-bottoms exchanger 42, a sufficient amount of the methanol fractionator bottoms stream can be withdrawn and replaced by fresh make-up water so as to maintain a concentration of ethylene glycol in the aqueous wash liquid carried by the conduit 2 of less than about 20% by volume. This purge stream is withdrawn from the conduit 110 by a conduit 120 communicating with the conduit 110 and routed for proper and safe disposal, such as by incineration. At least a portion of the contents of the conduit 110 are then conveyed to the conduit 2 by a suitable means for defining a flow path. Preferably, the conduit 110 empties into a heat exchanger 136 for cooling its fluid to a desired working temperature. A conduit 130 establishes communication between the heat exchanger 136 and a surge tank 132. A pump 134 in association with the conduit 2, which communicates with the surge tank 132, causes fluid flow through the line 2 and into the line 1. Make-up water is added to the surge tank 132 via a conduit 140 as needed to maintain the ethylene glycol concentration in the aqueous wash liquid below about 20% by volume.

Calculated flow rates, compositions, temperatures and pressures in the various lines in a commercial unit employing bypass of the glycol fractionator are set forth in the following table. The values are representative of typical flow rates which in actual practice vary and cause the balances in the table also to change.

TABLE

| Stream Number | 1 | 2 | 3 | 4 | 10 | 20 | 30 | 40 | 50 |
|---|---|---|---|---|---|---|---|---|---|
| Composition[1] | | | | | | | | | |
| Methanol | 620.9 | 3.0 | 623.9 | 0 | 623.9 | 5.8 | 618.1 | 618.1 | 10.1 |
| Ethylene Glycol | 149.9 | 2,915.2 | 3,065.1 | 0 | 3,065.1 | 4.1 | 3,061.0 | 3,061.0 | 8.6 |
| Water | 3,409.9* | 69,909.9* | 73,319.8* | 0* | 73,319.8 | 5.3 | 73,314.5 | 73,314.5 | 9.1 |
| $CO_2$ | 4,992.0 | — | 4,992.0 | 0 | 4,992.0 | 4,939.2 | 52.8 | 52.8 | 38.4 |
| $H_2S$ | 1,009.2 | — | 1,009.2 | 0 | 1,009.2 | 849.6 | 159.6 | 159.6 | 93.6 |
| Hydrocarbon ($C_1$—$C_6$+) | 477,944.8 | — | 477,944.8 | 477,825.6 | 119.2 | 88.0 | 31.2 | 31.2 | 31.2 |
| Suspended Solids | 1.4 | — | 1.4 | — | 1.4 | — | 1.4 | — | — |
| Temperature, °F. | 75 | 75 | 75 | 75 | 100 | 100 | 100 | 100 | 150 |
| Pressure, psia | 437.2 | 418.2 | 418.2 | 413.2 | 88.2 | 88.2 | 88.2 | 38.2 | 28.2 |

| Stream Number | 60 | 70 | 80 | 90 | 100 | 110 | 120 | 130 | 140 |
|---|---|---|---|---|---|---|---|---|---|
| Composition[1] | | | | | | | | | |
| Methanol | 608.0 | 29,920.5 | 26,315.7 | 604.8 | TR | 3.2 | 0.2 | 3.0 | — |
| Ethylene Glycol | 3,052.3 | TR | TR | TR | TR | 3,052.3 | 137.1 | 2,915.2 | — |
| Water | 73,305.4 | 4,750.7 | 4,642.9 | 107.8 | TR | 73,197.6 | 3,287.8 | 69,909.9 | 0** |
| $CO_2$ | 14.4 | 14.4 | TR | TR | 14.4 | — | — | — | — |
| $H_2S$ | 66.0 | 66.0 | TR | TR | 66.0 | — | — | — | — |
| Hydrocarbon ($C_1$—$C_6$+) | — | — | — | — | — | — | — | — | — |
| Suspended Solids | — | — | — | — | — | — | — | — | — |
| Temperature, °F. | 150 | 198.7 | 130 | 95 | 90 | 265 | 171 | 95 | — |
| Pressure, psia | 28.2 | 33.0 | 63.6 | 58.6 | 26.2 | 37.0 | 27.0 | 22.0 | — |

[1]Lb-Mols per stream day
*Free water only (excludes dissolved water)
**Make-up water is only added when the contaminants are deficient of free water While various preferred embodiments have been shown and described in terms of the presently preferred embodiment, reasonable variations and modifications are possible by those skilled in the art, within the scope of the described invention and the appended claims.

What is claimed is:

1. Process comprising:

(a) contacting a liquid stream comprising hydrocarbon as its major component and particulate and at least one contaminant selected from the group consisting of hydrogen sulfide, carbon dioxide, methanol, ethylene glycol, and amine as its minor component with an aqueous wash liquid stream comprising water as its major component to form a mixture comprising liquid hydrocarbon, aqueous wash liquid and particulate;

(b) withdrawing from said mixture a purified liquid hydrocarbon stream and a wash stream comprising water, particulate, and at least one contaminant selected from the group consisting of hydrogen sulfide, carbon dioxide, methanol, ethylene glycol and amine;

(c) filtering at least a portion of the particulate from the wash stream to form a filtered wash stream; and (d) recycling at least a portion of the filtered wash stream to the aqueous wash liquid stream whereby the aqueous wash liquid stream contains at least one contaminant selected from the group consisting of hydrogen sulfide, carbon dioxide, methanol, ehtylene glycol and amine as a minor component.

2. A process as in claim 1 wherein the hydrocarbon stream comprises $C_1$–$C_6$ hydrocarbons as its major component.

3. A process comprising contacting a liquid stream comprising $C_1$–$C_6$ hydrocarbons as its major component and particulate and at least one contaminant selected from the group consisting of water, hydrogen sulfide, carbon dioxide, methanol, ethylene glycol, and amine as its minor component with an aqueous wash liquid stream comprising ethylene glycol and water as its major component to form a mixture comprising liquid hydrocarbon, aqueous wash liquid and particulate;

electrostatically precipitating the aqueous wash liquid and particulate from the liquid hydrocarbon to form an aqueous phase containing particulate and a liquid hydrocarbon phase;

withdrawing a purified liquid hydrocarbon stream from the liquid hydrocarbon phase and a wash stream comprising particulate, water, ethylene glycol and at least one contaminant selected from the group consisting of hydrogen sulfide, carbon dioxide, methanol and amine from the aqueous phase;

filtering at least a portion of the particulate from the wash stream to form a filtered wash stream; and recycling at least a portion of the filtered wash stream to the aqueous wash liquid stream.

4. A process as in claim 3 wherein the at least one contaminant comprises at least ethylene glycol and wherein a sufficiently small portion of the filtered wash stream is recycled so as to maintain the concentration of ethylene glycol in the aqueous wash liquid stream below about 20 percent by volume.

5. A process as in claim 4 wherein the at least one contaminant further comprises at least methanol.

6. A process as in claim 5 further comprising fractionating at least a portion of the methanol from the filtered wash stream.

7. A process as in claim 6 wherein the at least one contaminant further comprises at least one of hydrogen sulfide and carbon dioxide.

8. A process as in claim 7 further comprising flashing at least a portion of the hydrogen sulfide and carbon dioxide from the filtered wash stream.

9. A process as in claim 4 wherein a major portion of the particulate comprises iron sulfide.

10. A process as in claim 9 wherein a major portion of the iron sulfide particulates have a size within the range of from about 0.5–1000 microns.

11. A process as in claim 3 further comprising fractionating at least a portion of filtered wash stream from the ehtylene glycol.

12. Apparatus comprising:

an electrostatic precipitator;

a filter;

a first conduit emptying into said electrostatic precipitator;

a first means for defining a flow path from a lower portion of the electrostatic precipitator to the filter; and a second means for defining a flow path between the filter and the first conduit comprising:

a methanol fractionator;

a third means for defining a flow path between the filter and the methanol fractionator; and a fourth means for defining a flow path from a lower portion of the methanol fractionator to the first conduit.

13. Apparatus as in claim 12 wherein the fourth means for defining a flow path comprises:

(a) a means for withdrawing a stream containing ethylene glycol from the fourth means;

(b) a second conduit establishing communication between the lower portion of the methanol fractionator and the means for withdrawing the stream containing ethylene glycol;

(c) a fifth means for establishing a flow path between the means for withdrawing the stream containing ethylene glycol and the first conduit.

14. Apparatus as in claim 13 wherein the means for withdrawing a stream containing ethylene glycol comprises an ethylene glycol fractionator.

15. Apparatus as in claim 12 wherein the means for withdrawing a stream containing ethylene glycol comprises a third conduit communicating with the second conduit.

* * * * *